US009089199B1

(12) United States Patent
Taylor

(10) Patent No.: US 9,089,199 B1
(45) Date of Patent: Jul. 28, 2015

(54) BACKPACK WITH FORMFITTING SKATEBOARD COMPARTMENT

(71) Applicant: Chanse Taylor, Las Vegas, NV (US)

(72) Inventor: Chanse Taylor, Las Vegas, NV (US)

( * ) Notice: Subject to any disclaimer, the term of this patent is extended or adjusted under 35 U.S.C. 154(b) by 216 days.

(21) Appl. No.: 13/791,541

(22) Filed: Mar. 8, 2013

(51) Int. Cl.
*A45F 3/04* (2006.01)

(52) U.S. Cl.
CPC ..... *A45F 3/04* (2013.01)

(58) Field of Classification Search
USPC ..... 224/627–630, 645, 652–654, 930
See application file for complete search history.

(56) References Cited

U.S. PATENT DOCUMENTS

| | | | | | |
|---|---|---|---|---|---|
| 3,019,952 | A * | 2/1962 | Brewster | 294/142 |
| D258,703 | S * | 3/1981 | Ogle et al. | D3/261 |
| 4,790,460 | A * | 12/1988 | Harper, Jr. | 224/644 |
| 5,344,056 | A * | 9/1994 | Challoner et al. | 224/581 |
| 5,887,770 | A * | 3/1999 | Covell | 224/153 |
| 6,585,137 | B1 * | 7/2003 | Archuleta | 224/617 |
| 6,712,249 | B2 * | 3/2004 | Magnusson et al. | 224/576 |
| D524,539 | S * | 7/2006 | Metzger et al. | D3/261 |
| D573,791 | S * | 7/2008 | Metzger et al. | D3/261 |
| D607,640 | S * | 1/2010 | Emile | D3/261 |
| D661,092 | S * | 6/2012 | Chen et al. | D3/270 |
| 2002/0179664 | A1 * | 12/2002 | Worden et al. | 224/586 |
| 2003/0042277 | A1 * | 3/2003 | Gulmatico, III | 224/153 |
| 2004/0238585 | A1 * | 12/2004 | Scarano | 224/613 |
| 2006/0049226 | A1 * | 3/2006 | Marik | 224/637 |
| 2007/0175939 | A1 * | 8/2007 | Gold et al. | 224/576 |
| 2007/0228091 | A1 * | 10/2007 | Shawen | 224/153 |
| 2008/0277434 | A1 * | 11/2008 | Sacks | 224/153 |
| 2009/0127299 | A1 * | 5/2009 | Jamlang | 224/153 |
| 2010/0108730 | A1 * | 5/2010 | Sabbah | 224/651 |
| 2011/0192877 | A1 * | 8/2011 | Murdoch et al. | 224/607 |
| 2012/0244768 | A1 * | 9/2012 | Oehlert et al. | 441/106 |
| 2012/0286011 | A1 * | 11/2012 | Wegener | 224/627 |

* cited by examiner

*Primary Examiner* — Brian D Nash
(74) *Attorney, Agent, or Firm* — Lightbulb IP, LLC

(57) ABSTRACT

A backpack with a formfitting skateboard compartment conveniently holds a skateboard freeing the user's hands for other tasks. The formfitting compartment reduces the size and bulk of the backpack allowing it to be easily worn without hindering skating activities. In this manner, a user may take his or her skateboard virtually anywhere. The formfitting compartment will typically conform to the shape of a skateboard inserted therein. The backpack may also include various additional compartments to carry other items for the user. In this manner, the backpack may be used as a knapsack or the like.

17 Claims, 3 Drawing Sheets

BACKPACK WITH FORMFITTING SKATEBOARD COMPARTMENT

BACKGROUND OF THE INVENTION

1. Field of the Invention

The invention relates to bags and carriers, and in particular to a backpack with a formfitting skateboard compartment and accessory compartments 2. Related Art Skateboarding is a popular activity enjoyed by many. Today, there are numerous parks, venues, and events specifically designated for skateboarding. In addition, skaters can skateboard at various other urban and other environments. Also, the skateboard is a popular means of transportation for younger people.

At times however, riding a skateboard is either not permitted or not advisable. For example, a skater may not be allowed to skate by virtue of laws or other regulations, or the skater may be in a crowded area where skating might be difficult or dangerous to others. In such cases, skaters often carry their skateboards manually from one place to another. A skateboard may be transported in a bag or other carrier as well. However, such carriers are not configured to carry a skateboard efficiently.

From the discussion that follows, it will become apparent that the present invention addresses the deficiencies associated with the prior art while providing numerous additional advantages and benefits not contemplated or possible with prior art constructions.

SUMMARY OF THE INVENTION

A backpack with formfitting skateboard compartment is disclosed herein. The backpack's formfitting compartment allows a skateboard to be carried therein while keeping the overall size and bulk of the backpack to a minimum. In addition, the size reduction as well as other features of the backpack allow it to be worn without hindering skating activities. This allows a skateboard to be conveniently carried virtually anywhere thus allowing the skateboard to be used as a form of transportation as well as for leisure or entertainment purposes.

The backpack herein may have various configurations. For example, in one embodiment, the backpack may comprise a formfitting compartment for receiving a skateboard. The formfitting compartment may comprise a resilient material configured to stretch around and conform to a deck of the skateboard, a first pouch configured to accept a first truck and set of wheels of the skateboard, a second pouch configured to accept a second truck and set of wheels of the skateboard, and a planer back section. The first pouch and second pouch will typically be formed from the resilient material, while the planer back section is not formed from the resilient material.

The first pouch and second pouch may be configured in various ways. For instance, the first and second pouch may be reinforced with thicker resilient material. Also or alternatively, the first and second pouch may be reinforced with one or more layers of additional resilient material. It is noted that the formfitting compartment may have a lining formed from one or more layers of additional fabric.

A fastener may be between the planer back section and the resilient material configured to secure the formfitting compartment in a closed configuration when closed and to allow access to the formfitting compartment when open. Two shoulder straps configured to engage a user's shoulders may be attached to the planar back section. The planer back section may be padded.

The backpack may also include one or more accessory compartments attached to the resilient material of the formfitting compartment. The accessory compartments may be attached to one another and to the formfitting compartment by one or more connecting cords.

In another exemplary embodiment, a backpack for carrying a skateboard may comprise a front section comprising a resilient material configured to stretch around and conform to the skateboard, and two or more pouches extending outward at the front section to receive trucks and wheels of the skateboard. The pouches will typically also be formed from the resilient material. The pouches may be reinforced.

A back section may be configured to engage a user's back. Two shoulder straps configured to engage the user's shoulders may be attached to the back section. One or more chest or waist straps may extend from the shoulder straps. One or more fasteners, such as one or more zippers, may removably secure at least a portion of the back section to the front section to allow the skateboard to be inserted and removed from the skateboard backpack. It is noted that the back section may be padded, and may comprise one or more compartments for storage of various items.

One or more accessory compartments for storage of various items may be attached to the front section. The accessory compartments may be removably attached to the front section by one or more connecting cords.

Various methods for carrying or transporting a skateboard are disclosed herein as well. For example, in one embodiment a method for carrying a skateboard with a skateboard backpack may comprise opening a fastener of a stretchable formfitting compartment of the skateboard backpack, opening the formfitting compartment by moving a non-stretchable back panel of the formfitting compartment away from a stretchable front section of the form fitting compartment, and inserting a skateboard into the formfitting compartment with the trucks and wheels being inserted into corresponding pouches of the formfitting compartment. The formfitting compartment may subsequently be opened to remove the skateboard.

The method may also include closing the fastener to secure the skateboard within the formfitting compartment, and carrying the skateboard backpack using shoulder straps of the skateboard backpack. The shoulder straps may be secured by connecting one or more chest or waist straps extending from the shoulder straps.

One or more accessory compartments may be secured to the front section of the skateboard backpack for additional storage. It is contemplated that the accessory compartments may be secured around the wheels of the skateboard with one or more connecting cords.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The backpack with formfitting skateboard compartment herein (the "skateboard backpack") is generally configured to receive a skateboard for storage and transport. Unlike traditional skateboard transport methods or apparatus (such as bags or carriers), the skateboard backpack can be worn while skating. As will be described further below, the formfitting compartment of the skateboard backpack reduces the skateboard backpack's size and bulkiness, thus allowing it to be worn without inhibiting skating.

In addition, the skateboard backpack frees its user's hands to carry or manipulate other items. Also, items besides a skateboard may be stored in various other compartments of the skateboard backpack. This allows the skateboard backpack to be used as a knapsack if desired. A student for example, may carry his or her skateboard along with a laptop, one or more books, other study materials, and/or food in the skateboard backpack.

Figure 1:
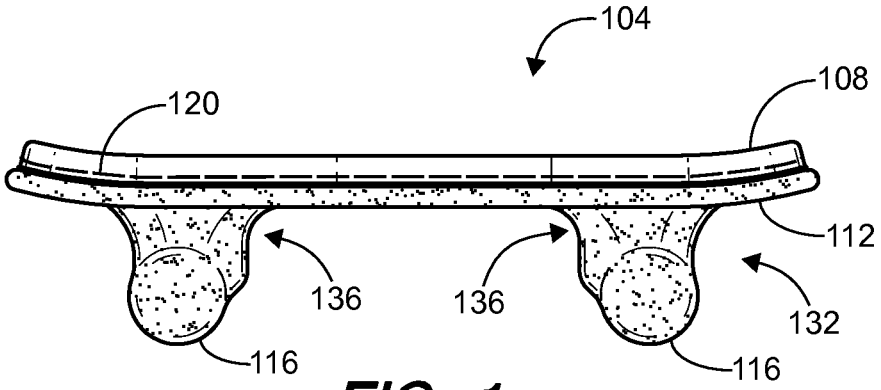
FIG. 1 is a side view of an exemplary backpack with formfitting skateboard compartment.

The skateboard backpack will now be described with regard to FIG. 1, which illustrates a side view of an exemplary skateboard backpack 104. As can be seen, the skateboard backpack 104 may comprise a front section 112 and a back section 108. When worn, the back section 108 will typically be positioned adjacent a user's back with the shoulder straps 128 of the skateboard backpack 104 over the user's shoulders. This secures the skateboard backpack 104 to the user. A carrying handle 124 may be provided in some embodiments to facilitate lifting or hanging of the skateboard backpack 104.

The back section 108 may be configured to support various components of the skateboard backpack 104. For example, the back section 108 may comprise a planar structure that generally defines the skateboard backpack's overall shape. The back section 108 may be a rigid material in one or more embodiments. Typically however, the back section 108 will be a flexible or semi-rigid material that allows for some flexibility while providing a structure to which various components of the skateboard backpack 104 may be attached. It is contemplated that the back section 108 may be padded or comprise one or more sections of padded material.

As can be seen, the front section 112 of the skateboard backpack 104 is configured to accept a skateboard therein. As can be seen, the front section 112 may conform to the general shape of a skateboard. For instance, the front section 112 of FIG. 1 comprises protruding sections or pouches 116 configured to accept the trucks and wheels of a skateboard. In addition, the front section 112 may be formed from a stretchable or resilient material/fabric, such as spandex or the like to create a formfitting compartment 132 around the skateboard. As can be seen from FIG. 1, the resilient fabric causes the front section 112 to squeeze around the deck and wheels of the skateboard, and tapering inward around the trucks of the skateboard.

The back section 108, though flexible, will typically not be stretchable as compared to the front section 112. This allows the back section 108 to provide a structure or shape to the skateboard backpack 104 as discussed above. As such, the back section 108 may be formed from fabrics such as nylon, Kevlar™ or other non-stretchable fabric. The shoulder straps 128 and other straps of the skateboard backpack will typically not be stretchable as well, though they may be lengthened or shortened using adjustment buckles or the like.

It is contemplated that various portions of the front section 112 may be reinforced to generate the formfitting compartment 132 around the skateboard. For example, thicker or additional layers of resilient fabric may be used to reduce the amount of stretching at particular areas of the front section 112. To illustrate, the resilient fabric may be thicker or have one or more additional layers (or otherwise reinforced) at the trucks 136 of the skateboard so as to taper inward at that location thus providing a formfitting compartment 132 around the trucks. Reinforcement may also be accomplished by attaching or using resilient fabric of different thicknesses and stretchability at areas where reinforcement is desired.

Reinforcement may be removable in some embodiments. For example, the skateboard backpack 104 may include one or more stretchable bands that can be placed around the pouches 116 to further secure the resilient material around the trucks and/or wheels of a skateboard. It is noted that reinforcement may also be used to strengthen the resilient material, increase its durability, or both.

The formfitting compartment 132 greatly reduces the size and bulkiness of the skateboard backpack 104, thus allowing it to be easily worn during skating, if so desired. This reduced size and bulkiness prevents the skateboard backpack 104 from inhibiting a user's movements while skating. This is highly advantageous in that other items in the skateboard backpack 104 can be carried by the user while the user is skating. When the user has finished skating or has skated to his or her destination, the skateboard can then be stored and transported in the skateboard backpack 104 as well. Once the skateboard is in the skateboard backpack 104, the users hands are free to carry or manipulate other items.

As will be described further below, a zipper 120 or other fastener may be used to allow a skateboard to be inserted into the skateboard backpack 104. In one or more embodiments, the zipper 120 may extend along the periphery of the skateboard backpack 104 to open and close the formfitting compartment 132 allowing a skateboard to be inserted into the skateboard backpack 104.

Figure 2:
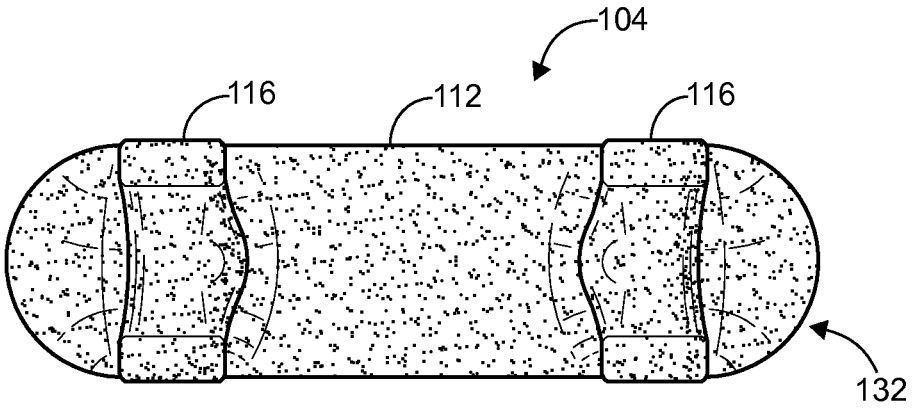
FIG. 2 is a back view of an exemplary backpack with formfitting skateboard compartment.

FIG. 2 illustrates a front view of an exemplary skateboard backpack 104. As can be seen, the wheels and trucks of a skateboard may be received in the pouches 116 of the front section 112. The resilient material forming the front section 112 collapses or squeezes inward around the skateboard, thus creating a formfitting compartment 132 around the skateboard. It is contemplated that each pouch 116 may receive one or more wheels and thus there may be one or more pouches in various embodiments of the skateboard backpack 104.

Figure 3:
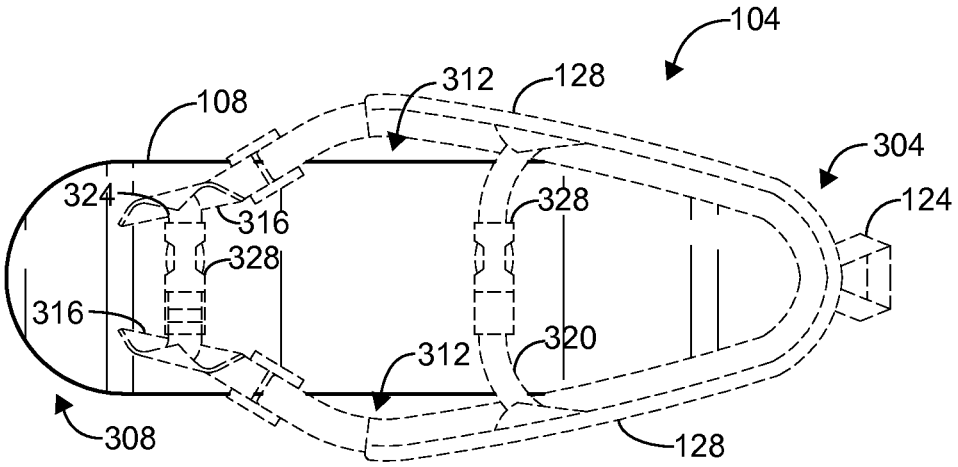
FIG. 3 is a front view of an exemplary backpack with formfitting skateboard compartment.

FIG. 3 illustrates a back view of an exemplary skateboard backpack 104. As can be seen, the back section 108 of the skateboard backpack 104 may comprise one or more shoulder straps 128. The shoulder straps 128 may be attached to the back section 108. For instance, as shown in FIG. 3, the shoulder straps are attached at a top end 304 and bottom end 308 of the back section 108. This creates openings 312 where a user may insert his or her arms and shoulders when the skateboard backpack 104 is worn. It is contemplated that the shoulder straps 128 may be sewn, adhered, or otherwise attached to the back section 108. In one or more embodiments, the back section 108 may have one or more mounts 316, such as in the form of nylon or other fabric, used to connect the shoulder straps 128 to the back section 108. It is noted that the shoulder straps 128 may have one or more buckles and/or be lengthened or shortened so as to fit users of various shapes and sizes.

It is contemplated that additional straps may be provided as well; such as to help ensure the skateboard backpack 104 is secured to its user. As shown in FIG. 3 for example, the skateboard backpack 104 may include a chest strap 320, waist strap 324, or both. These straps may include a buckle 328 or other coupling to allow the straps to be connected and disconnected and/or lengthened or shortened. This is advantageous in that it allows the user to skate without being bothered by swinging or other motion of the skateboard backpack.

Figure 4:
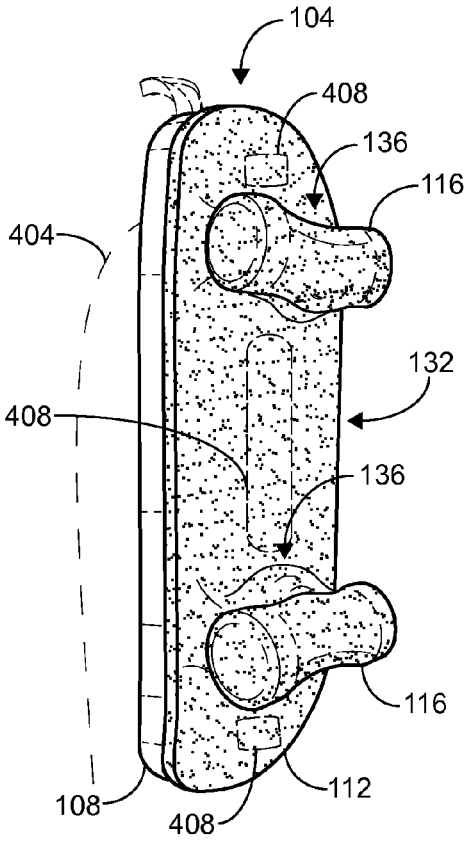
FIG. 4 is a perspective view of an exemplary backpack with formfitting skateboard compartment in a closed configuration.
Figure 5:
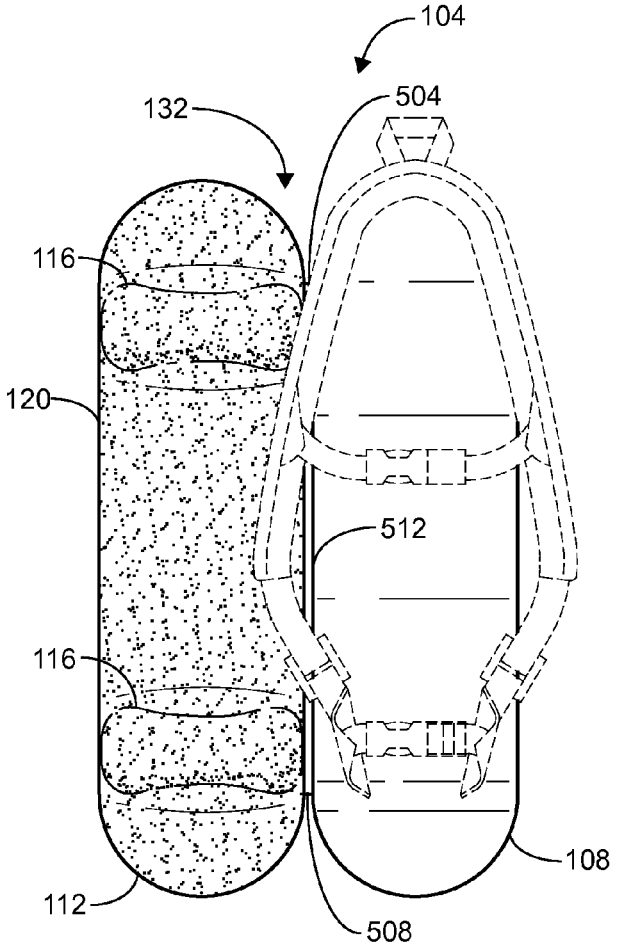
FIG. 5 is a perspective view of an exemplary backpack with formfitting skateboard compartment in an open configuration.

Operation of the skateboard backpack 104 will now be described with regard to FIGS. 4 and 5. FIG. 4 illustrates a perspective view of an exemplary skateboard backpack 104 in a closed configuration and worn on a user's back 404, while FIG. 5 illustrates a back view of an exemplary skateboard backpack 104 in an open configuration. As stated above, the skateboard backpack 104 may be opened to remove or insert a skateboard, and closed to enclose the skateboard within a formfitting compartment 132 of the skateboard backpack.

Referring to FIG. 4, it can be seen that the skateboard backpack 104 may be worn by placing the shoulder straps 128 on the user's shoulders. This holds the skateboard backpack 104 in position at the user's back 404. In the closed configuration of FIG. 4, it can be seen that the skateboard is secured in the formfitting compartment 132 of the skateboard backpack 104.

Referring to FIG. 5, it can be seen that the skateboard backpack 104 may be opened to remove or insert a skateboard. FIG. 5 provides an interior view of an exemplary formfitting compartment 132 formed by the front section 112 and the back section 108. In this view the pouches 116 of the front section 112 can be seen as providing compartments to accept the wheels and trucks of a skateboard.

As stated above, a zipper 120 or other fastener may be used to secure the formfitting compartment 132 in a closed configuration, while allowing the skateboard backpack to be opened when so desired. As can be seen, the zipper 120 may extend along the periphery of the skateboard backpack 104. In the embodiment of FIG. 5, the zipper 120 extends from a first anchor point 504 to a second anchor point 508. Though shown at a particular location, it is contemplated that the first anchor point 504 and second anchor point may be at various locations to adjust the extent to which the formfitting compartment 132 may open.

It is noted that one or more interior surfaces of the formfitting compartment 132 may have one or more liners, such as to protect the formfitting compartment 132 from wear and/or to cushion or protect a skateboard in the formfitting compartment. Alternatively or in addition, the formfitting compartment 132 may be reinforced (such as described above) at the ends, sides, or other areas where the edges of a skateboard come into contact with the formfitting compartment. It is contemplated that one or more liners may also be used to provide a lower friction surface to allow the skateboard to be more easily removed from or inserted into the formfitting compartment 132.

In use, the zipper 120 or other fastener may be unfastened (i.e., unzipped) to provide access to the interior of the formfitting compartment 132. A skateboard may be subsequently removed or inserted. When inserted, the pouches 116 will automatically conform to and squeeze around the trucks and wheels of the skateboard. This helps to ensure the skateboard is secured. The zipper 120 or other fastener may then be closed. The skateboard can be removed by opening the zipper 120 or other fastener and pulling the skateboard out of the formfitting compartment 132. Since the resilient material of the formfitting compartment is elastic/stretchable the skateboard can be conveniently removed as well.

Again, the skateboard backpack 104 is designed to allow a user to carry his or her items while the user is skating and thus the skateboard backpack can be used to carry items in virtually any circumstance (e.g., when the user is walking/running and when the user is skating). The experience of skating is uninhibited while wearing the skateboard backpack 104, and the user can easily and conveniently carried his or her skateboard in the skateboard backpack when not skating. When carried in the skateboard backpack 104, the user's hands remain free for carrying or manipulating other items since the user does not have to hand carry the skateboard.

As disclosed above, the skateboard backpack 104 may have various other compartments, carriers, pouches, and the like to carry other items besides the user's skateboard. For example, the shoulder straps 128 or other straps of the skateboard backpack 104 may have compartments to carry various items (typically of small size). As another example, the back section 108 of the skateboard backpack 104 may have one or more separate compartments for carrying items other than a skateboard. The skateboard backpack's compartments may have one or more openings for acceptance and removal of items and/or to allow items to extend into or out of such compartments. For example, a compartment may comprise an opening for headphone or other cables to extend out of the skateboard backpack 104 in one or more embodiments.

Figure 6:
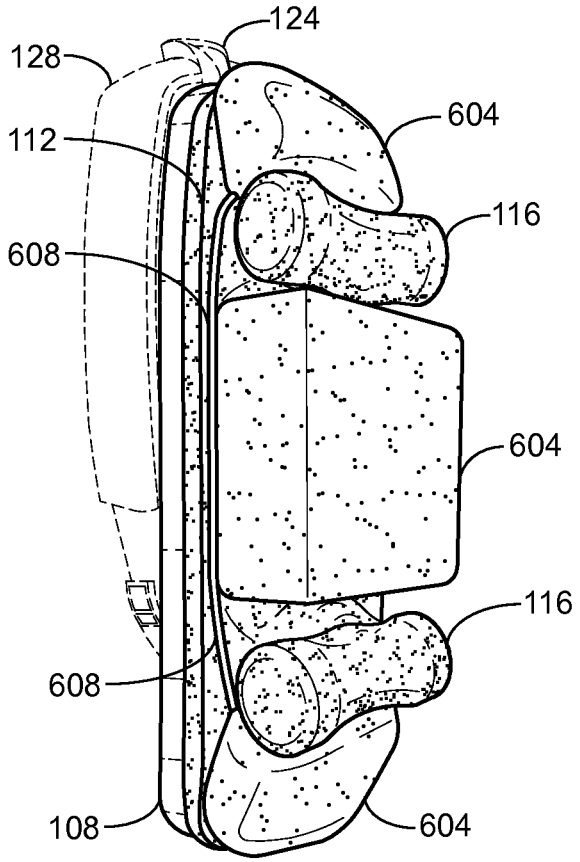
FIG. 6 is a perspective view of an exemplary backpack with formfitting skateboard compartment having accessory compartments.

FIG. 6 illustrates accessory compartments 604 or bags that may be provided with the skateboard backpack 104 for storage of various items. Such compartments 604 may have their own zippers or other fasteners to secure items therein. As can be seen, the accessory compartments 604 may be at the front section 112 of the skateboard backpack 104, and may be positioned adjacent the pouches 116 which accept the trucks and wheels of a skateboard. Though shown with three accessory compartment 604, it is noted that the skateboard backpack 104 may comprise fewer or additional accessory compartments.

In one or more embodiments, the accessory compartments 604 may be affixed at the front section 112 of the skateboard backpack 104. Alternatively, the accessory compartments 604 may be attached by removable fasteners so as to be removable from the skateboard backpack 104. Removable accessory compartments 604 may be removably attached in various ways. Referring to FIG. 4 for example, the front section 112 may have one or more hook and loop or other fasteners 408 (e.g., Velcro™) that mate with corresponding fasteners on the accessory compartments 604.

Alternatively or in addition, the accessory compartments 604 may be removably attached by a friction fit. For example, as shown in FIG. 6, the accessory compartments 604 are joined together by connecting cords 608, which press the accessory compartments against the wheels of a skateboard, thus securing the accessory compartments in place. In some configurations, a connecting cord 608 may be configured to wrap around the wheels of a skateboard to hold an accessory compartment 604 in place. It is noted that a connecting cord 608 may be an elastic or other resilient material. In addition, straps, pieces of fabric, or the like may be used in place of a connecting cord 608 in some embodiments.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A backpack comprising:

a formfitting compartment for receiving a skateboard comprising:

a resilient material configured to stretch around and conform to a deck of the skateboard;

a first pouch configured to accept a first truck and set of wheels of the skateboard;

a second pouch configured to accept a second truck and set of wheels of the skateboard; and a planer back section;

wherein the first pouch and second pouch are formed from the resilient material while the planer back section is not formed from the resilient material, and the first pouch and the second pouch are reinforced;

a fastener between the planer back section and the resilient material configured to secure the formfitting compartment in a closed configuration when closed and to allow access to the formfitting compartment when open; and two shoulder straps configured to engage a user's shoulders, the two shoulder straps attached to the planar back section.

2. The backpack of claim 1, wherein the planer back section is padded.

3. The backpack of claim 1, wherein the first pouch and second pouch are reinforced with one or more layers of additional resilient material.

4. The backpack of claim 1, wherein the formfitting compartment has lining formed from one or more layers of additional fabric.

5. The backpack of claim 1 further comprising one or more accessory compartments attached to the resilient material of the formfitting compartment.

6. The backpack of claim 5, wherein the one or more accessory compartments are attached to one another and to the formfitting compartment by one or more connecting cords.

7. A backpack for carrying a skateboard comprising:

a front section comprising a resilient material configured to stretch around and conform to the skateboard;

two or more pouches extending outward at the front section to receive trucks and wheels of the skateboard, the two or more pouches also formed from the resilient material, wherein the two or more pouches are reinforced;

a back section configured to engage a user's back;

two shoulder straps configured to engage the user's shoulders, the two shoulder straps attached to the back section; and one or more fasteners configured to removably secure at least a portion of the back section to the front section to allow the skateboard to be inserted and removed from the skateboard backpack.

8. The backpack of claim 7, wherein the one or more fasteners are zippers.

9. The backpack of claim 7, wherein the back section is padded.

10. The backpack of claim 7, wherein the back section comprises one or more compartments.

11. The backpack of claim 7 further comprising one or more chest or waist straps extending from the shoulder straps.

12. The backpack of claim 7 further comprising one or more accessory compartments attached to the front section.

13. The backpack of claim 12, wherein the one or more accessory compartments are removably attached to the front section by one or more connecting cords.

14. A method for carrying a skateboard with a skateboard backpack comprising:

opening a fastener of a stretchable formfitting compartment of the skateboard backpack;

opening the formfitting compartment by moving a non-stretchable back panel of the formfitting compartment away from a stretchable front section of the form fitting compartment;

inserting a skateboard into the formfitting compartment, wherein the trucks and wheels are inserted into corresponding pouches of the formfitting compartment;

closing the fastener to secure the skateboard within the formfitting compartment; and carrying the skateboard backpack using shoulder straps of the skateboard backpack;

wherein the one or more accessory compartments are secured around the wheels of the skateboard with one or more connecting cords.

15. The method of claim 14 further comprising securing one or more accessory compartments to the front section of the skateboard backpack.

16. The method of claim 14 further comprising opening the formfitting compartment to remove the skateboard.

17. The method of claim 14 further comprising securing the shoulder straps by connecting one or more chest or waist straps extending from the shoulder straps.

* * * * *